US005435467A

United States Patent [19]

Ekkert et al.

[11] Patent Number: 5,435,467

[45] Date of Patent: Jul. 25, 1995

[54] STACKABLE DISPENSER CLOSURE

[75] Inventors: Len Ekkert, Lemont; Bridgett E. Zemlo, West Chicago, both of Ill.

[73] Assignee: Phoenix Closures, Inc., Naperville, Ill.

[21] Appl. No.: 230,074

[22] Filed: Apr. 20, 1994

[51] Int. Cl.[6] ..... B67D 1/16

[52] U.S. Cl. ..... 222/109; 222/143

[58] Field of Search ..... 222/109, 143, 566, 570, 222/108; 53/367, 317, 331.5

[56] References Cited

U.S. PATENT DOCUMENTS

| | | | |
|---|---|---|---|
| 4,773,560 | 9/1988 | Kittscher | 222/109 |
| 4,917,268 | 4/1990 | Campbell et al. | 222/109 |
| 5,024,354 | 6/1991 | Ledewitz | 222/143 X |
| 5,058,772 | 10/1991 | Moore et al. | 222/109 |
| 5,203,836 | 4/1993 | Brazis et al. | 222/143 X |

FOREIGN PATENT DOCUMENTS

| | | | |
|---|---|---|---|
| 200762 | 7/1960 | Sweden | 222/143 |

*Primary Examiner*—Gregory L. Huson
*Attorney, Agent, or Firm*—Welsh & Katz, Ltd.

[57] ABSTRACT

A dispenser for a container having a pouring spout being integral with a spout portion and being disposed a retaining wall. The pouring spout of the dispenser is configured to allow orientation specific stacking whereby a spout portion is stacked onto a previously formed spout portion to form a stack of spout portions being aligned in the same direction. The dispenser includes an integral flow opening formed through an underside of the floor between the retaining wall and the pouring spout. The flow opening is coplaner with a horizontal plane through a juncture of the neck and the shoulder of the container and provides a channel through which the contents of the container can flow unobstructedly between the shoulder of the container and the lower end of the spout portion, which diminishes the amount of residual contents left within the container.

20 Claims, 3 Drawing Sheets

STACKABLE DISPENSER CLOSURE

The present invention relates to a dispensing packaging for containers designed to dispense the contents of the container when inverted for pouring, and more specifically, to a dispenser closure having a self-aligning feature that facilitates orientation specific stacking; also included is an improved evacuation feature formed on the spout portion of the package.

Conventional dispenser closures used for pouring the container contents often consist of two components, a spout portion which projects vertically beyond the upper margins of the container neck and a cap portion which is threaded onto the neck and usually serves as a measuring cup. This type of closure is commonly used for containers of liquid household laundry detergent and related liquid products, although the closure of the present invention is not restricted to any specific type of application.

One disadvantage of conventional dispenser closure packages is that as part of the manufacturing process, the spout portions are typically stacked prior to application to a container and the eventual application of the cap. Stacking of the spout portions also facilitates the storage, packaging and shipment of the dispenser closure to the bottler. With conventional screw on spout portions, the threading is configured to allow proper alignment and orientation to the container within a few degrees of error. Screw on spouts are costly and inaccuracies in the threads may result in a defective looking product. Accordingly, where appropriate, snap-on type spout portions are more desirable. However, with snap-on spout portions it is essential to have all the spout portions properly aligned prior to application to the container to insure the correct orientation of the spout with respect to the container and the pouring handle.

The caps of the dispenser closure package are by convention inherently easy to stack and separate by the application process. However, the spout portions that are stacked may become lodged to one another and prevent an orderly application process at the bottling site. Furthermore, conventional spout portions of dispensing packages do not lend themselves to stacking in a particular orientation, such that the spout portions of the stack are all oriented in the same direction for easy and consistent application to the containers.

Another major disadvantage with conventional dispensing packages is that their structure interferes with the fluid flow of the container contents, and therefore, a significant amount of product remains in the container. The amount of residual product remaining in a container has been found to be quite significant with some dispensing packages. Of course, the user does not get full use of a product that was paid to be used completely. Instead, a tremendous amount of waste results, since the typical user simply will throw out the container, believing it to be empty when in fact it may contain a significant amount of residual product that could be used.

Further, although there have been many attempts to increase the drip back of product into the container once pouring is complete, many of the currently available dispenser packages still need improvement.

Thus, there is a need to provide a dispenser package having a simple to use stacking capability and which is designed for increased evacuation of product and improved drip-back of product.

Accordingly, it is an object of the present invention to provide a stackable dispenser closure that will allow the manufacturer to stack and ship the spout portion in a predetermined orientation without the spout portions becoming lodged together.

It is a further object of the present invention to provide a dispenser closure having an improved evacuation feature that permits a greater amount of product to exit the container and thereby minimize the amount of residual product.

It is yet another object of the present invention to provide a stackable dispenser closure having an inherent alignment system, an improved evacuation feature and an increased drip-back of product into the container.

SUMMARY OF THE INVENTION

Accordingly, the dispenser closure of the present invention provides a two-piece closure including a preassembled spout portion which is snap fit into the container neck and is configured for locking engagement therewith. The spout portion includes provisions for the drainage of any excess material back into the container. The spout portion is also configured to provide a self aligning capability of spout portions during stacking. The spout portion further includes a lower spout formation that increases the egress of liquid product out from the container.

More specifically, a first embodiment of the present dispenser closure includes a spout portion having an outer annular spout retaining wall provided with a lower end, a central portion and an upper end. The central portion has an integral, radially projecting bead which mates or cooperates with the inside of the container neck finish to lock the spout portion in the proper orientation within the container neck.

The bead is directed to securing the spout portion horizontally within the container neck. The upper end of the annular outer retaining wall has an integral outwardly tapered lip configured to fit snugly against the container neck finish and help secure the spout portion to the container. The lip is nearly flush with the mouth of the container, but extends sufficiently outward to enable the inner wall of the measuring cup of the cap portion to be directed into the pour back area defined by the outer retaining wall.

The lower end of the spout portion includes a gateway or cut out aligned with the front or pour side of the spout to facilitate the flow of product from the container and out the spout. The gateway is formed on the lower end of the spout portion where residual product would otherwise be obstructed from flowing out due to the container shoulder and the lower end of the spout portion. The lower end of the spout portion also includes at least two leveling legs that are flush with the lower end of the inner finish of the spout.

The body portion of the spout itself has a channel cut through the rear portion of the spout which runs from the upper portion of the spout to the lower portion adjacent an inclined floor and drainage hole. The sides of outer finish of the spout have at least two opposed anti-nesting lugs that prevent the stacked spout portions from lodging together. The front or pouring side of the spout has a generally "Y"-shaped channel and groove configuration that is designed to cooperate with a centering flange on a subsequent spout portion during stacking procedures to provide a self-aligning feature that allows for proper orientation of the spout portions prior to assembly onto a container. Both the Y-channel, and to a lesser degree the centering flange, also function to accelerate drain-back of the container product after the user pours and returns the container to an upright position by facilitating the coalescence of the product. The centering flange also tends to provide a channeling effect of product that is allowed to evacuate the container through the gateway.

Between the spout and the retaining wall of the spout portion there is formed an inclined floor or gutter that gradually declines until terminating at a drainage hole. The drainage formation provides for the return of product that drips back down from the measuring cup of the closure and along the outer finish of the spout. The drainage hole is also preferably aligned with the spout and is in fluid communication with the spout and the inclined floor to also facilitate the drainage of any residual material from the container out the end of the spout formation.

A cap portion includes a generally tubular wall with a lower end having a radially projecting annular shoulder with a depending collar, the collar being threaded on an interior surface to engage the threaded exterior surface of the upper end of the wall.

In a second embodiment of the present invention, the channel and groove formations are replaced with a uniquely configured spout that ensures that spout portions being formed into a stack are all oriented the same. More specifically, the spout is configured with two flattened sidewalls and a generally arched pouring side that will only slide over a previous spout portion having this configuration if it is oriented in the same direction as that previous spout portion,

Figure 1:
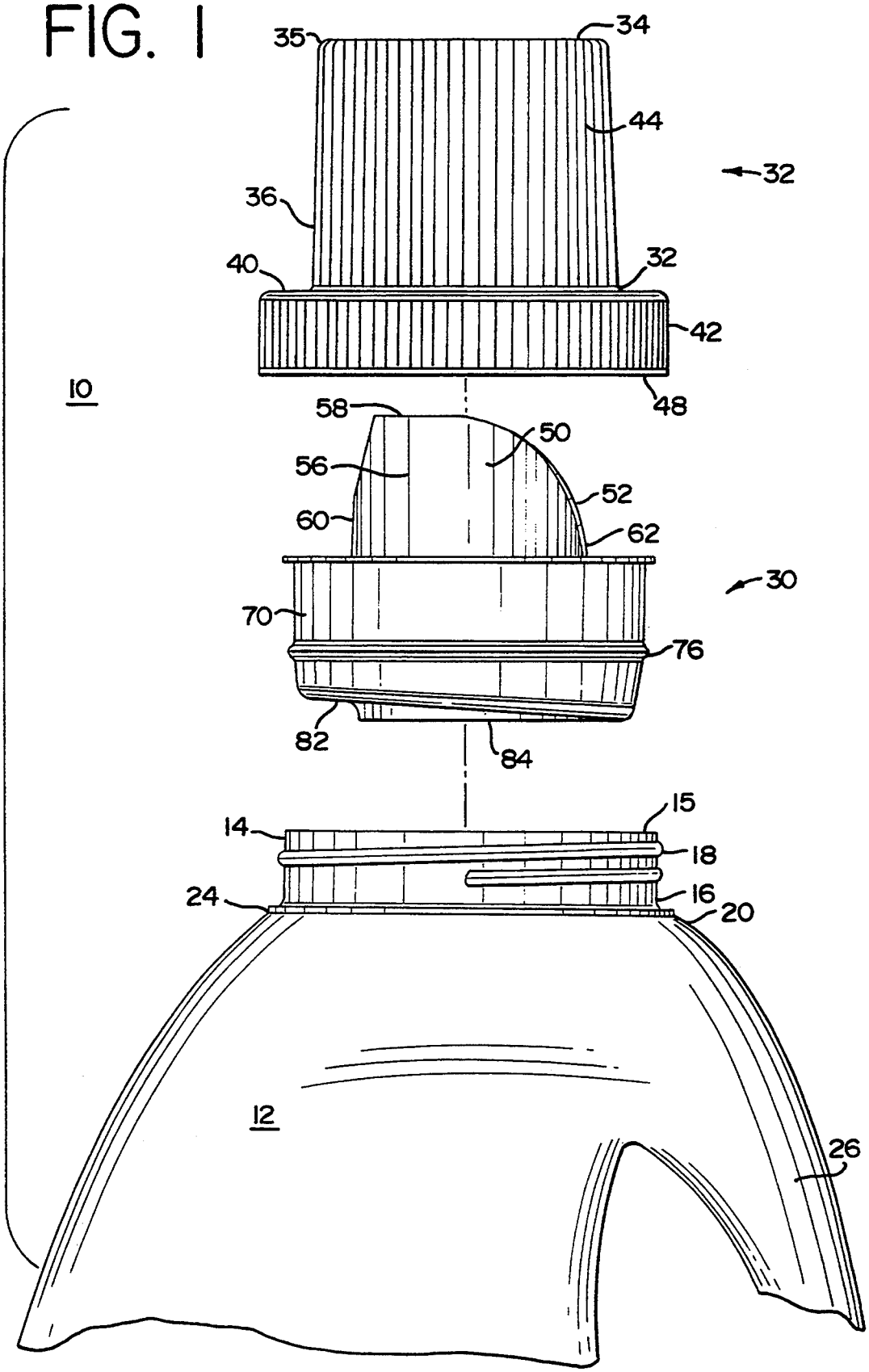
FIG. 1 is an exploded side elevational view of the first embodiment of the dispenser closure of the invention and a corresponding container.
Figure 6:
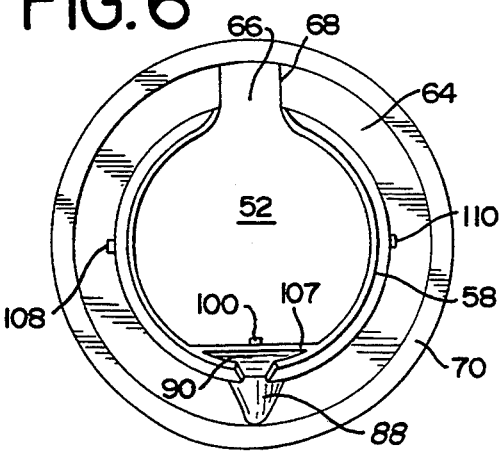
Figure 7:
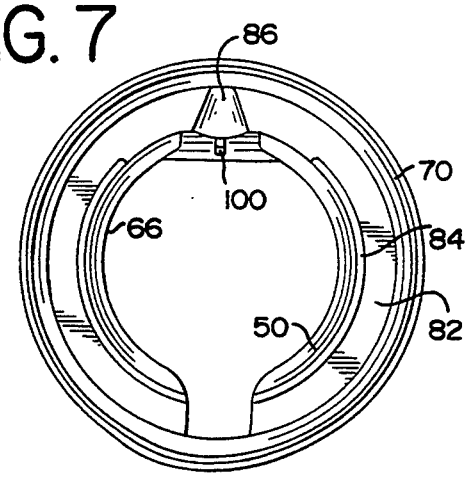
Figure 8:
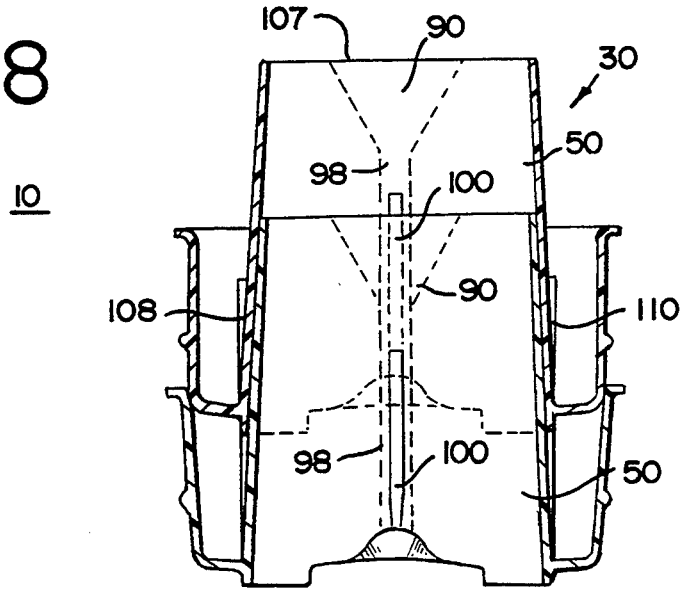
Figure 9:
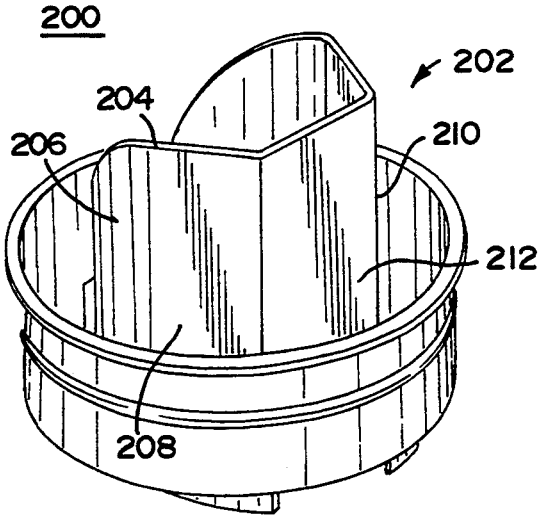
Figure 10:
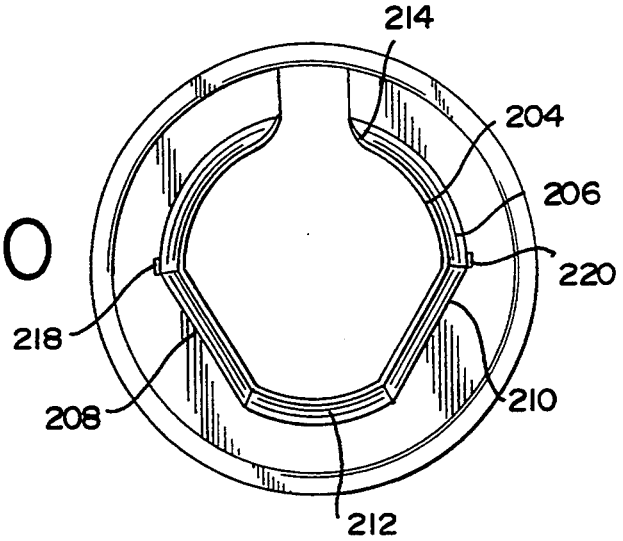

FIG.. 5 is a rear view of the present spout portion;

FIG. 6 is an overhead plan view of the spout portion shown in FIG. 1;

FIG. 7 is a bottom plan view of the present spout portion;

FIG. 8 depicts a spout portion of the present invention being stacked onto another of the present spout portions in a predetermined orientation with the present self-aligning feature;

FIG. 9 is a perspective view of the front or pouring side of a second alternative embodiment of the present invention; and FIG. 10 is an overhead plan view of the second embodiment.

DESCRIPTION OF THE PREFERRED EMBODIMENT

Figure 2:
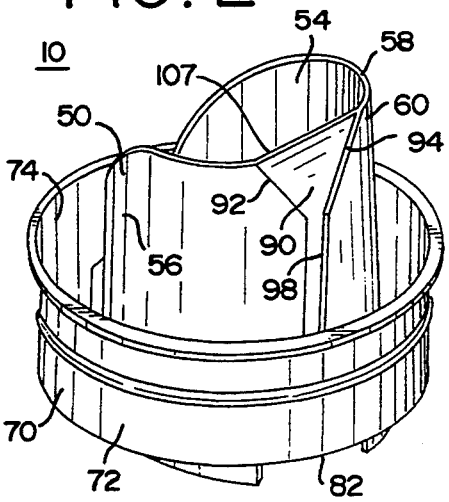
FIG. 2 is a perspective view of the front or pouring side the present spout portion.
Figure 3:
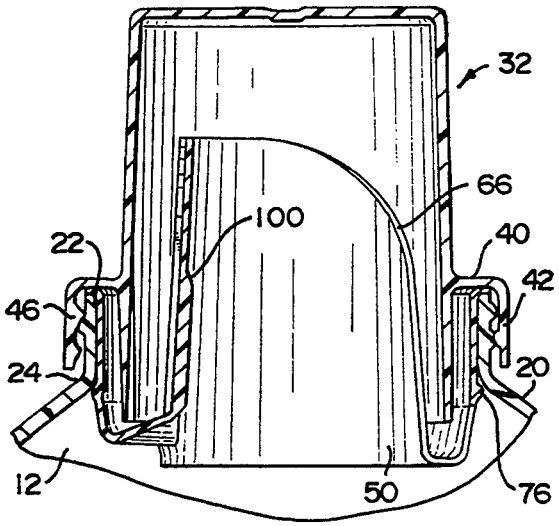
FIG. 3 is a sectional side view of the present dispenser closure secured to the container.

Referring now to FIGS. 1–3, the first embodiment of the dispenser package of the present invention is generally designated as 10 and is shown exploded from a typical container 12. The container 12 includes a mouth 14, an upper edge 15, and a neck 16 having threads 18 on an exterior surface thereof. A radially projecting peripheral shoulder 20 is located at the base of the neck 16. The neck 16 has an inside finish 22 and a juncture 24 where the neck 16 integrates with the shoulder 20. The container 12 will typically include a handle 26 to facilitate holding the container 12 or when pouring the contents 28 out from the container. The container 12 may be manufactured of a suitable polymeric material, but the specific material used depends on specific needs of the bottler and the substance held within the container 12. The dispenser package 10 is essentially a two piece assembly having a spout portion 30 and a separate cap portion 32.

The cap portion 32 includes a generally flat closed top 34, a generally tubular wall 36 depending from the top end 34 and having a lower end 38. The lower end 38 is provided with a radially projecting annular shoulder 40 having a depending collar 42. To enhance the user's grip of the cap portion 32, the tubular wall 36 may include a plurality of spaced, generally parallel, external gripping ribs 44. The collar 42 is provided with threads 46 on an interior surface 47. The threaded interior surface 47 is configured to threadably engage the threading 18 of the container 12.

It is shown that in the cap portion 32, the tubular wall 36 at its lower end 38 projects vertically downward below a lower edge 48 of the collar 42. The lower edge 48 is preferably dimensioned to slidingly engage the inner finish 74 of the retaining wall 70 of spout portion 30. Thus, if the cap portion 32 is used as a measuring cup for the contents 28 of the container 12, when the contents are poured from the cap 32, the threads 46 on the collar 42 will not be exposed to the container contents 28. The annular shoulder 40 may also be provided with at least one annular sealing rib 49 which provides a more secure seal between the cap portion 32 and the annular wall 28.

Referring to FIGS. 1 through 5, a spout 50 is integral with the spout portion 30 and is preferably molded as part of the spout portion 30. The spout 50 includes an opening 52 which provides fluid communication with the interior of the container 12 and is disposed through the length of the spout 50. The spout 50 is generally frustoconical having an inside finish 54 and an outer finish 56. The spout 50 has an upper edge 58 which curves downwards from a front or pouring side 60 to a rear or channel side 62. The upper edge completes its downward curve at a floor 64 and forms a channel 66 which is an open slot running the length of the rear side 62 of the spout 50. The channel 66 extends into or is coexistent with the floor 64. The configuration of the spout 50 and the presence of channel enable a steady flow of product to exit the container 12. Channel 66 allows ventilating air to enter the container 12 and help provide force against the contents that together with gravity enables a steady flow stream of product to exit the container 12. The sides of the upper edge 58 may be tapered to help prevent spillage and further enable directional flow when pouring the contents 28.

The spout portion 30 also includes an outer annular retaining wall 70 which extends integrally from the floor 64 upwards to enclose the spout 50. The retaining wall 70 has an outer finish 72 and an inner finish 74. The retaining wall 70, as will be more fully explained hereinafter, enables the spout portion 30 to be received, by a snap or snug friction fit, to the container neck 16.

As shown in FIGS. 6 and 7 the floor 64 is situated between the lower end of the outer finish 56 and the lower portion of the inner finish 74 of the remaining wall 70, and is substantially continuous therein between except for the drainage hole 68. The drainage hole 68 is generally formed through the floor 64 and extends vertically up onto a section of the lower end of the spout 50, as well as up into the retaining wall 70. It is preferred that the drainage hole 68 be formed at the lowermost point along the incline of the floor 64. The floor 64 is inclined to enable the drainage of any excess or residual material, from the spout 50 back into the container 12 once the container resumes its normal vertical post-pouring position. Thus, the opposing sides of the floor 64 terminate at the drainage hole 68. For this reason, the floor 64 actually acts as a gutter or trough to catch liquid draining or dripping down from the outer finish 56 of the spout 50 or the inner finish 74 of the wall 70 and to enable that product to flow downward along the floor 64 and through the drainage hole 68 into the container 12.

It is contemplated that the drainage hole 68 will be substantially rectangular or circular in shape, but other configurations not herein specifically disclosed can be utilized without departing from the principles of the present dispenser package 10. As shown most clearly in FIGS. 6 and 7, the drainage hole 68 extends through the floor 64, and up into the spout 50 and the wall 70. This particular arrangement of the drainage hole 68 increases the consistency of the flow, in terms of the egress speed and quantity, when the user tilts or inverts the container 12 to use the product. The drainage hole 68 accomplishes this by permitting a steady stream of ventilating air to enter the container 12 when the container 12 is tilted over or inverted by the user. Accordingly, the present drainage hole 68 serves a dual purpose. First, it provides a draining system for the return of unused material back into the container 12. Secondly, it functions to allow a steady stream of ventilating air into the container 12 to help force the contents out.

Figure 4:
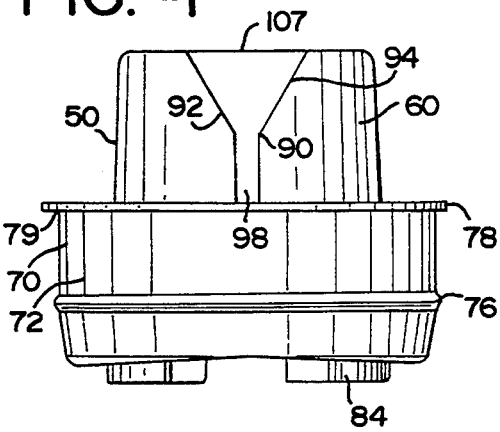
FIG. 4 is an front side view of the spout portion shown in FIG. 1.
Figure 5:
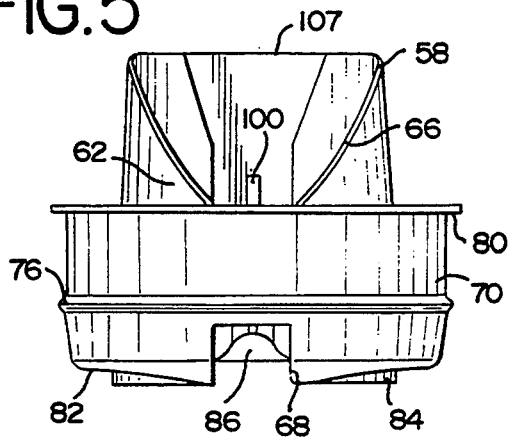

Snap-on type dispenser closures, like 10 here, utilize an annular bead 76 integrally formed on the outer finish 72 of the retaining wall 70. Referring to FIGS. 3–5, the location of the bead 76 on the outer finish 72 is dependent on the size and style of the container 12, since the bead 76 is designed to abut or interfere with the inside finish 22 of the neck 16 at the juncture 24. The bead 76 is intended to prevent the spout portion 30 from inadvertently falling or slipping out the neck 16. Therefore, it would be preferred that the bead 76 be configured somewhat like a ledge, having an upper and lower surface that are almost completely horizontal and a front surface which is at a right angle to the upper and lower surfaces. However, from a manufacturing standpoint, this is expensive, and therefore, as a compromise between cost and functionality the bead 76 is usually undercut, staying as horizontal as possible within the confines of molding processes. As long as the bead 76 catches the container, particularly at juncture 24, it will serve its securing function.

To further ensure the desired snug fit of the spout portion 30 to the container neck 16, a tapered lip 78 is integrally formed along the upper end 79 of the retaining wall 70. The lip 78 extends outward a sufficient amount to cooperate with the container and lie flush against the upper edge 15 of the container neck 16. The lip also helps to direct the lower end 34 of the cap 32 to fit inside the retaining wall 70 and against the inner finish 74 of the wall 70.

Also, as shown in FIGS. 4 and 5, the lower end 82 of the spout 50 should include at least two leveling legs 84 that form a tripod with the lower end 82, actually the bottom side of the floor 64, to maintain the spout portion 30 in an upright position, thus facilitating manipulation by vertically-oriented automatic handling equipment during processing. The leveling legs 84 are necessary because the inclined floor 64 creates an angled lower end 82 that could topple over and complicate the stacking and alignment processes.

In addition to the drainage feature, the present dispenser closure 10 also includes a gateway 86, shown in FIGS. 5–7, that is designed to prevent the retention of container contents 28 within the spout portion 30 when the container 12 is inverted in a pouring position. Thus, the lower end 82 of the spout portion 30 may be provided with an additional gateway or drain flow opening 86 which is in fluid communication with the spout 50 and the interior of the container 12. The opening 86 is substantially coextensive with the lower end of the inner finish 54 and is angled upwards and enlarges or spans out from the outer finish 70 to the inner finish 54. Once the spout portion 30 is snapped into the container neck 16, the opening 86 is situated in a coplaner relationship with the horizontal plane that cuts across the juncture 24. When the container 12 is inverted for pouring, any residual liquid will be able to flow through the opening 86 and out the spout 50 with only negligible obstruction from the lower end 82 of the spout 50 or the shoulder 20. The opening 76 is preferably located opposite the drainage formation 56.

This particular configuration of the opening 86 creates a bump 88 on the floor 64. The bump 88 actually helps to accelerate the accumulation, or coalescence, of the droplets of contents as they return or drain back into the container 12 via the floor 64. It must be understood that the particular size of the opening 86 will form a respectively sized bump 88 and may obstruct the lower end 38 of the cap 32 from entering the spout portion 30 upon application of the cap 32 to the container 12. Thus, if a deeper opening 86 is desired, the cap 32 must be designed with a taller or wider cup to maintain the volume required of the cup while preventing it from abutting the bump 88.

The present dispenser package 10 not only addresses the problems of the egress and drain back of container contents 28, but also, from a manufacturing perspective, includes a unique self-aligning feature. Snap-on type spouts are generally cheaper to make, since they are made of high density, thin-walled material that do not require machinery or special molding to form threads, and have therefore become more popular than screw-on type spouts. However, with snap-on type spout formations, like the present one 30, it is more cost effective and efficient to have the stack of spout portions aligned in a predetermined direction so that they will be properly oriented when snapped into the container neck 16. Spout portions 30 are generally sold in bulk quantities and packaged and shipped in pre-arranged stacks.

It is essential that the spout portion 30 be secured to the container neck 16 to orient the spout 50 in the correct direction with respect to the handle 26 or body of the container 12 for pouring. If the spout 50 is oriented wrong, then the product will be difficult to pour and create more problems than the dispenser was intended to solve. Ordinarily, there is no way to insure that each of the individual spout portions 30 will align properly. In fact, the direction of the spout 50 coming off the production line is often entirely random. Accordingly, these spout portions 30 must be properly aligned and stacked or aligned by the bottler. This is expensive and time-consuming. The present spout portion 30 is configured to solve these problems by being inherently self-aligning during the stacking process.

To this end, the spout portion 30 includes an alignment directing channel 90, shown most clearly in FIGS. 2, 4 and 5. The channel 90 has been found to be most effective when formed generally in the shape of the letter Y. Other configurations are contemplated but are not expressly described herein. The directing channel 90 is formed as an indentation directly into the outer finish 56 of the spout 50, and preferably along the front side 60 thereof. The directing channel 90 has two sidewalls 92 and 94 which angle inwards from their respective starting points along the upper edge 58 of the spout 50 forming the V-like portion.

The sidewalls 92 and 94 angle inwards until they begin to form the groove 98 that completes the Y formation of the alignment feature in this embodiment. Preferably, the groove 98 extends down and is coextensive with the floor 64, or the bump 88 if one exists. It has been found that the channel 90 and the groove 98 do not only function in the alignment process of the spout portions 30 during stacking, but also accelerates coalescence and increases the amount of drainage of the product after pouring since the product is directed down what is essentially a track to the floor 64. Therefore, although not required, it is preferred that the groove 98 extend down to the floor 64 or bump 88 to accentuate drain back.

Referring additionally to FIG. 8, in order for the channel 90 and groove 98 to effectuate its aligning function, it requires the inclusion of a corresponding centering flange 100. Accordingly, it is contemplated and preferred that each spout portion 30 have both the channel 90 and the flange 100 so that aligned stacking is easily performed without having to set up a system of matching spout portions 30 having only a channel 90 versus spout portions having only a flange 100. Flange 100 is preferably integrally formed on the inner finish 54 of the spout 50 and runs vertically from the lower end 55 of the inner finish 54 to a point approximately the height of the V channel 90. Thus, the flange 100 will typically be about the length of the groove 98. Of course other lengths may work equally as well, but it has been found that the preferred length of flange 100 offers the additional benefit of providing some degree of acceleration to product dripping back into the container.

The flange 100 acts as a vein into which the product can coagulate and travel down into the container 12 before drying out and sticking to the spout 50. The flange 100 must not be larger in width than the width of the groove 98 since the flange 100 must be able to slide down into the groove 98 to effectuate alignment. In fact, to ensure proper slidability, it is preferred that the width of the flange 100 be well within the boundaries formed by the sidewalls 92 and 94 and groove 98.

Additionally, to prevent the stacked spout portions 30 from inadvertently locking together, the spout 50 has formed on its outer finish 56 anti-nesting lugs 108 and 110. It is preferred that two lugs be utilized, but one may be found to work sufficiently and reduce costs. As shown in FIG. 6, the lugs 108 and 110 are diametrically opposed and formed between the front and rear sides 60 and 62 of the spout 50. The lugs 108 and 110 should be of a length sufficient to contact the inner finish 54 of the subsequent spout portion 30 which is stacked onto it but not too long that it interferes with the appropriate stacking of the spout portions 30. Typically, the lugs 108 and 110 will be shorter than the height of the retaining wall 70.

As can best be seen in FIGS. 2 and 6, the alignment feature of the present dispenser package 10 may also effect the configuration of the upper edge 58 of the spout 50. As is depicted, the upper edge 58 actually forms a channel 112 that cuts across or bridges the upper edge along the front side 60 of the spout 50. Also, the channel 112 and what amounts to the V portion of channel 90 taper inward slightly. This tapered configuration performs three functions. First, and more importantly, it facilitates the alignment process because it allows the subsequent spout portion 30 to more easily slide over the previous spout portion 30 in the stacking process and to direct the flange 100 to fit into the channel 90. Secondly, the tapered spout 50 allows for a more controlled, directional fluid flow of the container contents 28 during pouring. Thirdly, the tapered spout 50 functions to terminate the fluid flow more efficiently when the user begins to return the container 12 to an upright position, while preventing wasteful dribble of the product and also initiating the drain back of product into the container 12 by providing a ramp or slide down towards the container 12.

Having described the inventive features of the present dispenser package 10, it should be apparent how the spout portion 30 alleviates many of the problems associated with conventional dispensers. Accordingly, with reference to FIG. 8, it should be understood that a stacking process using the present dispenser package 10 will force all the spouts 50 of a given stack to be aligned in the same direction for efficient application, in the correct orientation, to the container 12. As the spout portions 30 are formed, the previous spout portion(s) 30 becomes the stacking medium for a subsequent spout portion 30. The previous spout 50 will be engaged by or fit into the opening 52 of the subsequent spout 50 and so on and so on until the orientation specific stack is completed.

The previous spout portion(s) 30 will be oriented in a pre-determined direction and, since the spouts 50 include a channel 90 and a corresponding flange 100, the subsequent spout portion 30 will be forced to be oriented respectively in order to fit onto the stack. The flange 100 of the subsequent spout portion 30 will prevent that spout 50 from sliding down and engaging the stack until the flange 100 catches and mates with the channel 90 of the previous spout 50. Once the flange 100 catches and mates with the channel 90, the flange 100 will be directed by sidewalls 92 and 94 into and slide down the groove 98, thereby engaging the previous spout portion 30 in the proper orientation and becoming part of the aligned stack. The alignment process will be repeated until a stack of a predetermined number of spout portions 30, all orientated in the same direction, is completed and the next stack commences.

In a second embodiment, designated generally as 200, the above description of the various component parts applies except to the extent of the alignment feature. Although the spout portion is identical in all other respects, as shown in FIGS. 9 and 10, the spout portion 202 includes neither the channel 90 having groove 98 nor the centering flange 100. Instead, in this second embodiment 200, the upper edge 204 of the spout 206 takes on a different configuration which also inherently provides self-alignment of respective spout portions 202 during stacking processes.

As shown, it is preferred that the spout 206 have two flats 208 and 210 and a generally arched front side 212. The two flats 208 and 210 are shown to extend horizontally from a midpoint approximately between the front side 212 and the rear side 214. The two flats 208 and 210 evolve into the arched front side 212. This particular configuration of the spout 206 inherently lends itself to alignment because the respective spouts 206 of the spout portions 202 will only stack onto each other when the spouts 206 are oriented in the same direction such that the spout 206 of a previous spout portion 202 in the stack fits into the opening 208 of the subsequent spout 206 being added to the stack. This configuration can be thought of as a keying system whereby the spout portion 202 will fit onto the stack if and only if it is oriented in the same way as the previous spout portions 202 of the stack.

The spout portions 202 are inherently self-aligning since the specific configuration of the upper spout 206 will only fit, or matingly cooperate, with the spout 206 of a previously stacked spout portion 202 if it matches the orientation of the stack. The two flats 208 and 210 and front side 212 will prevent the spout portion 202 being added to the stack from fitting over or sliding onto the stack if it does not match since they will be obstructed by the generally circular back side 214 of the previous spout portion 202 of the stack.

The flats 208 and 210 of spout 206 are preferred to run the length of the spout 206, but it is contemplated that other configurations, such as half length, will work adequately. If the flats 208 and 210 are made to extend from the edge 204 to a point somewhere before the lower end 216 of the spout 206, then the anti-nesting lugs 218 and 220 can be removed, since the flats 208 and 210 themselves can perform some limited anti-nesting function. However, it is preferred that anti-nesting lugs 218 and 220 be included. Also, the flats 208 and 210 can be formed to angle inwards slightly to facilitate the engagement between the spout portions 202 as well as increasing the control and direction of product during pouring.

The second embodiment has been found to be easy to mold and relatively inexpensive to manufacture, since there are no cut-outs or other formations to mold. Also, aesthetically, the second embodiment may be found to have greater appeal to the consumer. Further, as with the first embodiment, the second embodiment increases capping/application speed, since alignment and orientational problems are alleviated.

From a manufacturer, bottler and distributor point of view, because the present dispenser packages 10 and 200 are cheaper to make and easier and quicker to apply to containers, they cut costs and increase profits. From a consumer's point of view, the present dispenser packages 10 and 200 may decrease or stabilize the price of the product, but also function to increase product use since both evacuation and drainage of product is improved over conventional dispenser packages.

Assembly of the closure 10 to the container 12 is simple and efficient. The container 12 is first filled with the specified contents, normally a liquid. Next, the preassembled, integral spout portion 30 is snapped into the neck 16 of the container 12. Since the spout portions 30 will be orientation specifically stacked, there is no need to manually turn or align the spout portion with respect to the container. Typically, the desired orientation will be one in which the pouring side 60 extends away from the handle 26. Once the spout portion 30 is secured to the container 12, the cap portion 32 is threaded onto the container 12 so that the threads 46 of the collar 42 engage the threads 18. When the cap portion 32 is tightly threaded onto the spout portion 30, sealing ribs (not shown) are placed in a contact relationship with the upper edge 15 of the neck 16 to prevent the leakage of container contents 28. The container 12 of the given product is now ready for shipping to the public.

While two particular embodiments of the dispenser closure of the invention have been shown and described, it will be appreciated by those skilled in the art that changes and modifications may be made thereto without departing from the invention in its broader aspects and as set forth in the following claims.

What is claimed is:

1. A dispenser for a container, the container having an inner and outer finish the container having a neck coextensive at its lower end with a shoulder and a mouth terminating at an upper edge, the dispenser comprising:

a first spout portion having an outer annular retaining wall provided with an upper end, a lower end, an inner finish and an outer finish, said upper end forming an outwardly extending annular lip, said lower end being coextensive with a floor disposed within said retaining wall;

a pouring spout integral with said spout portion and disposed within said retaining wall, said pouring spout having an upper end, a lower end, an interior surface and an exterior surface, said pouring spout being coextensive with said floor which thereby connects said pouring spout to said retaining wall; and stacking means integral with said pouring spout for providing an inherent alignment feature whereby said spout portion can be stacked onto a second spout portion to form a plurality of orientation specifically stacked dispensers.

2. The dispenser as defined in claim 1 wherein said floor encircles said lower end of said pouring spout and is enclosed such that a highest point is located opposite a drainage opening, said drainage opening being formed through said floor.

3. The dispenser as defined in claim 1 wherein said retaining wall has integrally formed thereon, proximate to said lower end and said upper end, means for securingly snapping the dispenser into the neck of the container, said securing means being configured to abut the inside finish of the container substantially along the shoulder of the container.

4. The dispenser as defined in claim 3 wherein said securing means is configured as an integrally formed annular interference bead extending radially outwards from said outer finish of said retaining wall.

5. The dispenser as defined in claim 1 wherein said pouring spout includes means for preventing said spout portions from lodging together after being stacked.

6. The dispenser as defined in claim 5 wherein said means is configured as at least one anti-nesting lug integrally formed on the outer surface of said pouring spout, said anti-nesting lug extending substantially vertical with respect to said pouring spout, said anti-nesting lug having a length no greater than half the height of said pouring spout.

7. The dispenser as defined in claim 1 wherein said spout portion includes product evacuation means for providing unobstructed egress of the contents of the container from the container when inverted for pouring and thereby diminishing the amount of residual contents left within the container.

8. A dispenser as defined in claim 7 wherein said evacuation means is an integral flow opening formed through an underside of said floor, said flow opening being coplaner with a horizontal plane extending through a juncture formed at the intersection of the neck and the shoulder of the container, said flow opening providing a channel through which the contents of the container can flow substantially unobstructedly beyond the shoulder of the container and said lower end of said spout portion.

9. The dispenser as defined in claim 1 wherein said stacking means comprises a centering flange, a directing channel and an alignment groove, said centering flange being formed to engage said directing channel of a previously stacked spout portion upon being stacked onto said pouring spout of said previously stacked spout portion whereby said centering flange is slidingly directed down into said directing channel which slidingly directs said centering flange down into said alignment groove of said pouring spout of said previously stacked spout portion.

10. The dispenser as defined in claim 8 wherein said centering flange is integral with said inside surface of said pouring spout, said directing channel and said alignment groove are integral with said outer surface of said pouring spout at a location directly bordering with said centering flange, said directing channel and said alignment groove being in direct communication and together form a substantially Y-shaped groove.

11. A first dispenser for a container, the container having an inner and outer finish, the container having a neck coextensive at its lower end with a shoulder and a mouth terminating at an upper edge, the dispenser comprising:

a spout portion having an outer annular retaining wall provided with an upper end, a lower end, an inner finish and an outer finish, said upper end forming an outwardly extending annular lip, said lower end being coextensive with a floor disposed within said retaining wall;

a pouring spout being integral with said spout portion and disposed within said retaining wall, said pouring spout having an upper end, a lower end, an interior surface and an exterior surface, said pouring spout being coextensive with said floor which thereby connects said pouring spout to said retaining wall; and a centering flange, a directing channel and an alignment groove all being integrally formed on said spout portion, said centering flange of a second dispenser being formed to engage said directing channel of said spout portion of said first dispenser upon being stacked onto said pouring spout of said first dispenser whereby said centering flange of said second dispenser is slidingly directed down into said directing channel of said first dispenser which slidingly directs said centering flange of said second dispenser down into said alignment groove of said pouring spout of said first dispenser such that a plurality of said spout portions can be stacked to form a orientation specific stack of said spout portions.

12. The dispenser as defined in claim 11 wherein said floor encircles said lower end of said pouring spout and is enclosed such that a highest point is located opposite a drainage opening, said drainage opening being formed through said floor.

13. The dispenser as defined in claim 11 wherein said pouring spout includes means for preventing said spout portions from lodging together after being stacked.

14. The dispenser as defined in claim 13 wherein said means is configured as at least one anti-nesting lug integrally formed on the outer surface of said pouring spout, said anti-nesting lug extending substantially vertical with respect to said pouring spout.

15. The dispenser as defined in claim 11 wherein said spout portion includes product evacuation means for providing unobstructed egress of the contents of the container from the container when inverted for pouring and thereby diminishing the amount of residual contents left within the container.

16. A dispenser as defined in claim 15 wherein said evacuation means is an integral flow opening formed through an underside of said floor, said flow opening being coplaner with a horizontal plane extending through a juncture formed at the intersection of the neck and the shoulder of the container, said flow opening providing a channel through which the contents of the container can flow substantially unobstructedly beyond the shoulder of the container and said lower end of said spout portion.

17. The dispenser as defined in claim 11 wherein said centering flange is integral with said inside surface of said pouring spout, said directing channel and said alignment groove are integral with said outer surface of said pouring spout at a location directly bordering with said centering flange, said directing channel and said alignment groove being in direct communication and together form a substantially Y-shaped groove.

18. A dispenser for a container, the container having an inner and outer finish and being adapted to house fluid contents, the container having a neck coextensive at its lower end with a shoulder and a mouth terminating at an upper edge, the dispenser comprising:

a spout portion having an outer annular retaining wall provided with an upper end, a lower end, an inner finish and an outer finish, said upper end forming an outwardly extending annular lip, said lower end being coextensive with a floor disposed within said retaining wall;

a pouring spout being integral with said spout portion and disposed within said retaining wall, said pouring spout being coextensive with said floor which thereby connects said pouring spout to said retaining wall; and said pouring spout being configured with two flattened sidewalls which are coextensive with an arched pouring side, said configuration of said pouring spout having an alignment means for orientational stacking whereby said spout portion can be stacked onto a previously formed spout portion to form a stack of said spout portions being aligned in substantially the same direction.

19. The dispenser as defined in claim 18 wherein said two sidewalls extend horizontally from a midpoint proximate a front side and a rear side said pouring spout and extend substantially the length of the pouring spout.

20. The dispenser as defined in claim 18 wherein said pouring spout includes at least one anti-nesting lug integrally formed on the outer surface of said pouring spout for preventing said spout portions from lodging together after being stacked.

* * * * *